US010022035B2

(12) United States Patent
Dabade et al.

(10) Patent No.: US 10,022,035 B2
(45) Date of Patent: Jul. 17, 2018

(54) DISHWASHER ILLUMINATING SYSTEM

(71) Applicant: WHIRLPOOL CORPORATION, Benton Harbor, MI (US)

(72) Inventors: Sujay Sunil Dabade, Solapur (IN); Benjamin Fulbright, Berrien Springs, MI (US); Nic Kesterke, Berrien Springs, MI (US); Ryan K. Roth, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 12 days.

(21) Appl. No.: 15/372,931

(22) Filed: Dec. 8, 2016

(65) Prior Publication Data

US 2018/0160880 A1 Jun. 14, 2018

(51) Int. Cl.

| | |
|---|---|
| ***A47L 15/42*** | (2006.01) |
| ***F21V 23/06*** | (2006.01) |
| ***F21V 31/00*** | (2006.01) |
| ***F21S 4/28*** | (2016.01) |
| ***F21V 19/00*** | (2006.01) |
| ***F21V 17/14*** | (2006.01) |
| ***F21V 33/00*** | (2006.01) |
| *F21Y 115/10* | (2016.01) |

(52) U.S. Cl.

CPC ..... *A47L 15/4246* (2013.01); *A47L 15/4274* (2013.01); *F21S 4/28* (2016.01); *F21V 17/14* (2013.01); *F21V 19/003* (2013.01); *F21V 23/06* (2013.01); *F21V 31/005* (2013.01); *F21V 33/0044* (2013.01); *F21Y 2115/10* (2016.08)

(58) Field of Classification Search

CPC ..... A47L 15/4246; F21V 33/0044

See application file for complete search history.

(56) References Cited

U.S. PATENT DOCUMENTS

| | | | | |
|---|---|---|---|---|
| 7,380,559 | B2 * | 6/2008 | Son | A47L 15/4246 134/200 |
| 7,651,232 | B2 * | 1/2010 | Baumgartner | A47L 15/4246 362/652 |
| 8,047,683 | B2 | 11/2011 | Olesen et al. | |
| 8,277,065 | B2 * | 10/2012 | Camarillo Fernandez | F24C 15/02 362/311.01 |
| 2014/0230865 | A1 | 8/2014 | Rehm et al. | |
| 2014/0338708 | A1 | 11/2014 | Boyd et al. | |

(Continued)

FOREIGN PATENT DOCUMENTS

| | | | |
|---|---|---|---|
| DE | 102014222586 | A1 | 5/2016 |
| EP | 1543761 | A2 | 6/2005 |

(Continued)

OTHER PUBLICATIONS

European Search Report for Counterpart EP17206247.3, dated May 29, 2018.

*Primary Examiner* — Robert May

(74) *Attorney, Agent, or Firm* — McGarry Bair PC

(57) ABSTRACT

In one aspect, a dishwasher having sidewalls at least partially defining a treating chamber and defining an access opening, a rack rail mount, and a rack rail coupled to the tub mount slidably mounting a dishrack. The tub mount includes at least a light source and an electrical connection configured to provide electrical connection from the light source to a wiring harness adjacent the sidewall.

18 Claims, 5 Drawing Sheets

(56) References Cited

U.S. PATENT DOCUMENTS

| | | | | |
|---|---|---|---|---|
| 2015/0208897 | A1 | 7/2015 | Kangas et al. | |
| 2017/0268766 | A1* | 9/2017 | Grohmann | F21V 33/0044 |

FOREIGN PATENT DOCUMENTS

| | | | |
|---|---|---|---|
| EP | 2366323 | A1 | 9/2011 |
| EP | 2898809 | A1 | 7/2015 |
| WO | 2014173749 | A1 | 10/2014 |

* cited by examiner

DISHWASHER ILLUMINATING SYSTEM

BACKGROUND OF THE INVENTION

Contemporary automatic dishwashers for use in a typical household include a tub defining a treating chamber and a spraying system for recirculating liquid throughout the tub to remove soils from dishes and utensils. The dishwasher is generally provided with a door pivotally mounted to the tub that provides access to the treating chamber. Multilevel dishracks for holding dishes to be cleaned are typically provided within the treating chamber and mounted to the tub by extensible support rack rails.

BRIEF DESCRIPTION OF THE INVENTION

In one aspect, a dishwasher includes a tub having sidewalls at least partially defining a treating chamber. A tub mount is coupled to each of the sidewalls in the treating chamber, and each rack rail has one or more electrical connections to a wiring harness adjacent the sidewall. A rack rail is mounted to each tub mount for supporting a dishrack for movement into and out of the treating chamber. A light is mounted to each tub mount and connected to the electrical connection.

In another aspect, a lighting system for a dishwasher includes a tub mount configured to mount a rack rail to a sidewall of a treating chamber in a dishwasher. One or more electrical connections in the tub mount is configured to connect to a wiring harness adjacent the sidewall. A light is mounted to the tub mount and connected to the electrical connection.

DESCRIPTION OF EMBODIMENTS OF THE INVENTION

Figure 1:
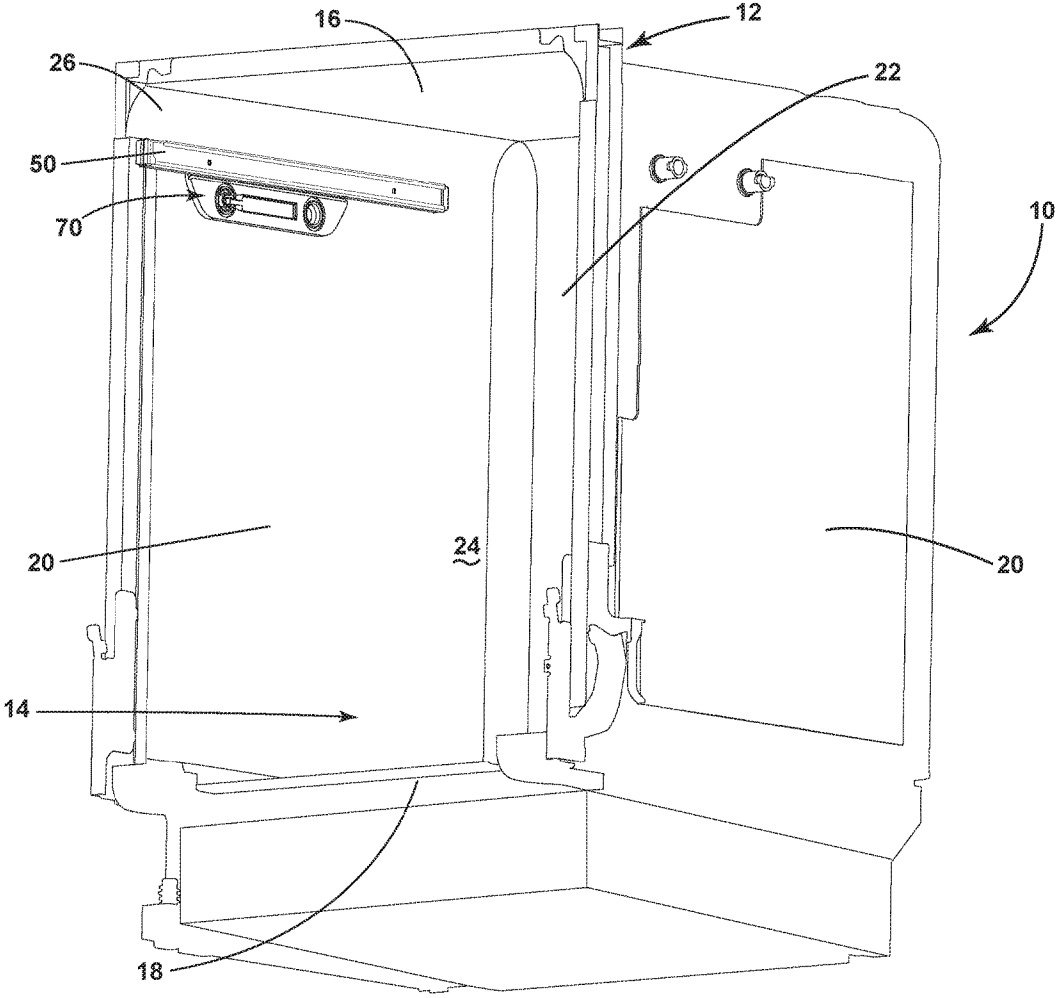
FIG. 1 is a perspective view of a dishwasher with a door shown in an opened position, and having a tub mount mounted on both sidewalls.

In FIG. 1, an automated dishwasher 10 according to one embodiment of the invention is illustrated. The dishwasher 10 can treat dishes according to an automatic cycle of operation. Depending on whether the dishwasher 10 is a stand-alone or built-in, a cabinet 12 of the dishwasher 10 may be a chassis/frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers, multi-tub dishwashers, or drawer-type dishwashers.

A tub 14 is disposed within the cabinet 12 and has spaced top and bottom walls 16 and 18, spaced side walls 20, and a rear wall 22. The walls 16, 18, 20, and 22 join along their respective edges to define a treating chamber 24 with an access opening 26.

A door (not shown) is hingedly mounted to the dishwasher 10 and can move between an opened position to provide access to the treating chamber 24 and a closed position to close the treating chamber 24 by covering the access opening 26 of the treating chamber 24. Typically, the door is in the opened position when utensils are loaded or unloaded into the dishwasher 10 and in the closed position while the washing cycle is running or while the dishwasher 10 is not in use.

Utensil holders in the form of dishracks (not shown) are located within the treating chamber 24 and receive utensils for washing. The dishracks are typically mounted to side walls 20 for slidable movement in and out of the treating chamber 24 for ease of loading and unloading and can be in the form of a wire-frame. A tub mount 70 is mounted to each of the side walls 20 and a rack rail 50 is mounted to the tub mount 70. The rack rail 50 slidably mounts dishracks to the side walls 20 of the tub 14 so that the dishracks can glide in and out of the access opening 26 of the treating chamber 24.

Utensil holders will hold various utensils for washing within the treating chamber 24. As used in this description, the term utensil is generic to dishes and the like that are washed in the dishwasher 10 and expressly includes, dishes, plates, bowls, silverware, glassware, stemware, pots, pans, and the like.

Figure 2:
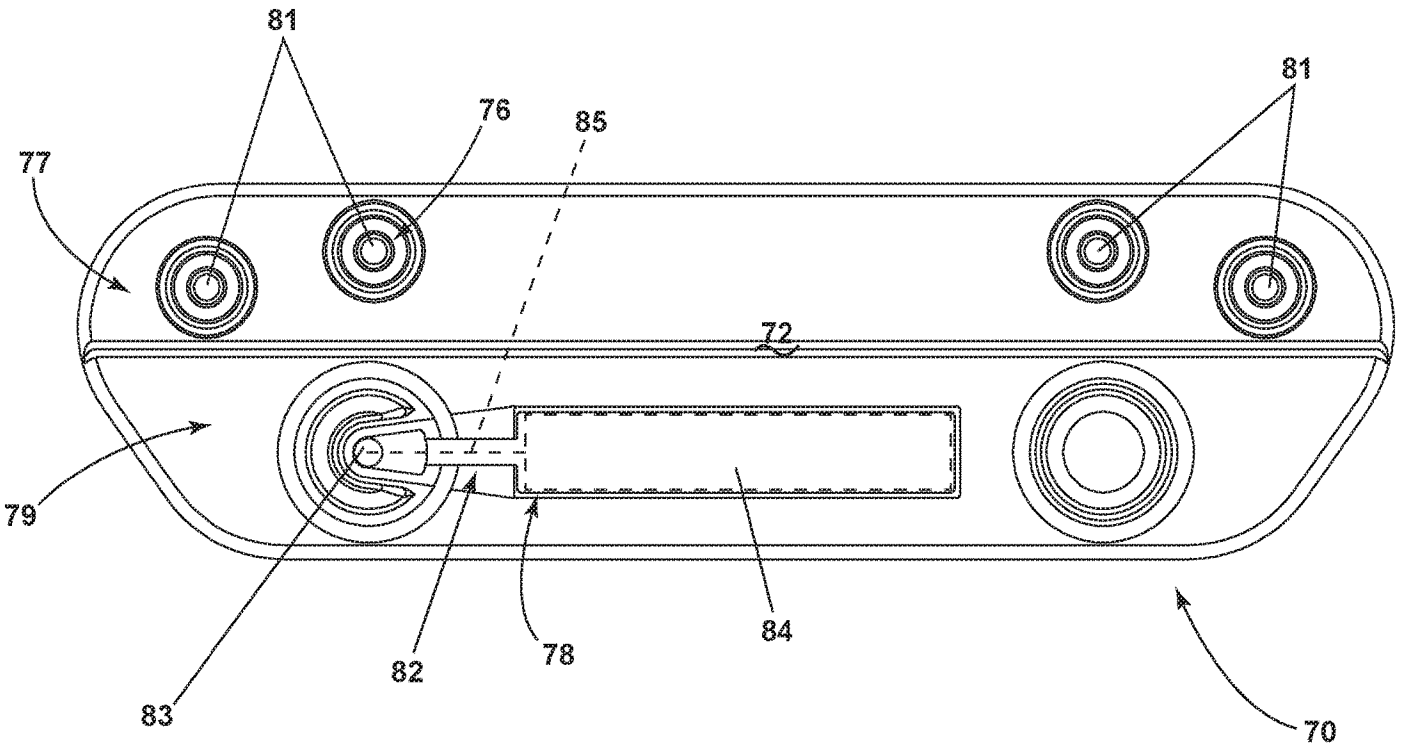
FIG. 2 is a front view of the tub mount in FIG. 1 with a lighting system.
Figure 3:
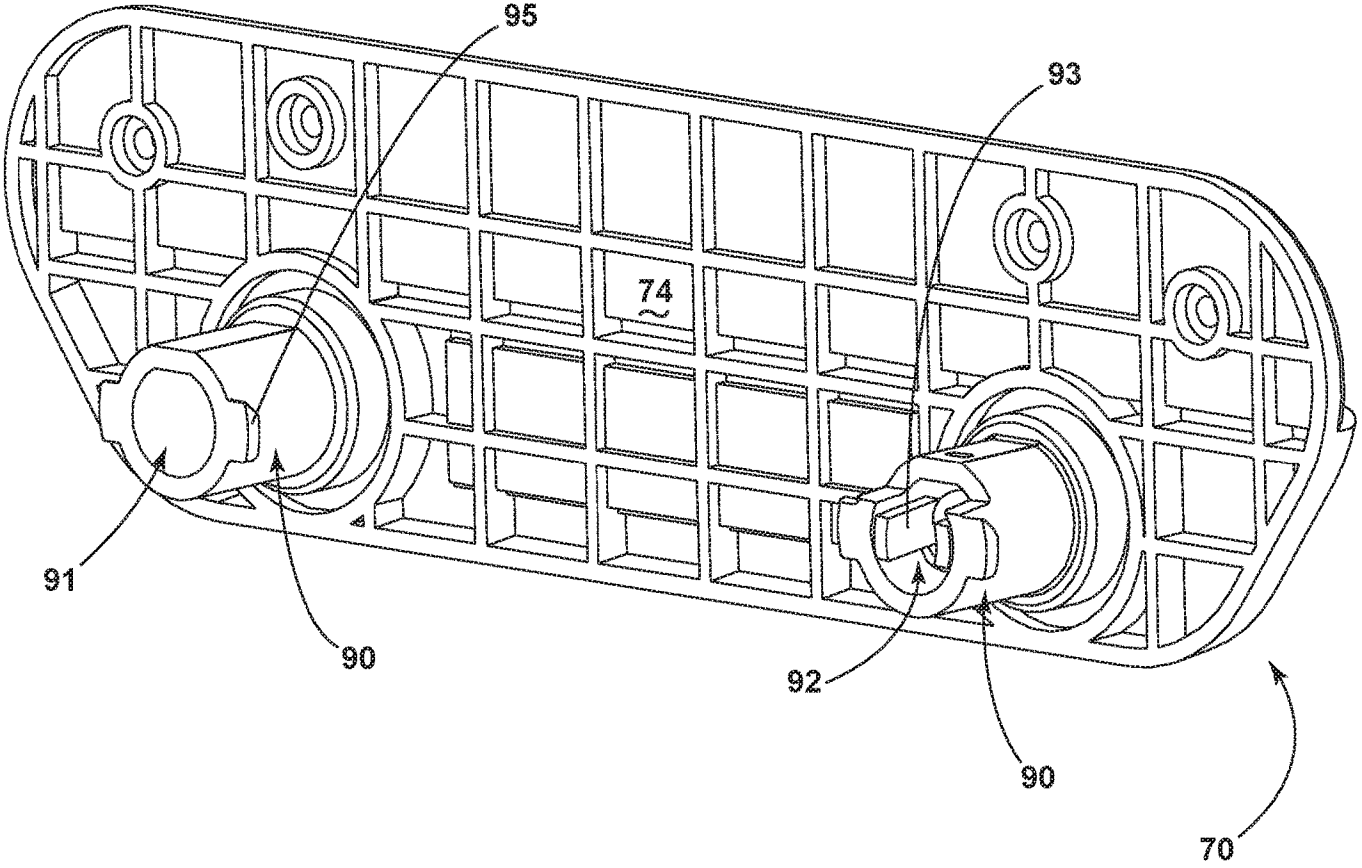
FIG. 3 is a perspective view of the rear surface of the tub mount in FIG. 1 having an integrated RAST connector.

FIGS. 2 and 3 illustrate a tub mount 70 according to an embodiment of the present invention. The tub mount 70 comprises a front surface 72 and a rear surface 74. The front surface 72 of the tub mount 70 faces the interior of the treating chamber 24 (FIG. 1). The front surface of the tub mount 70 comprises a rack rail attachment point 76 at an upper portion 77 and a light housing 78 at a lower portion 79. The rack rail attachment point 76 comprises plurality of apertures 81 to receive fastening elements including but not limited to screws or snap-lock mechanisms to mount the rack rail 50 onto the tub mount 70. The light housing 78 includes a wiring channel 82 with an aperture 83 that extends between the front surface 72 and the rear surface 74. A light source 84 can be affixed to the light housing 78 via adhesives or fasteners with an electrical wiring 85 passing through the wiring channel 82. As a non-limiting example, the light source 84 can be in the form of an LED light bar, LED strip, or multiple one-point LEDs. A lens (not shown) from a refractive material can be used to seal the light source 84 and the wiring 85 within the light housing 78 via a sealer gasket, waterproof adhesives, ultra-sonic welding, or vibe-welding. The lens (not shown) functions both to disperse the light for uniform lighting and to waterproof the light source 84 and wiring 85 from exposure within the treating chamber 24 during washing operation.

The rear surface 74 of the tub mount 70 includes a plurality of structural attachment points 90 to mount the tub mount 70 to the side walls 20 (FIG. 1). The rear surface 74 of the tub mount 70 further includes at least one electrical connector 92, such as a RAST connector 93 seated within one of the structural attachment points 90 which corresponds with the aperture 83 (FIG. 2) of the wiring channel 82 (FIG. 2). Electrical wires 85 (FIG. 2) from the light source 84 (FIG. 2) can be coupled to the RAST connector 93 which provides an electrical connection extending through the aperture 83 and structural attachment point 90.

Figure 4:
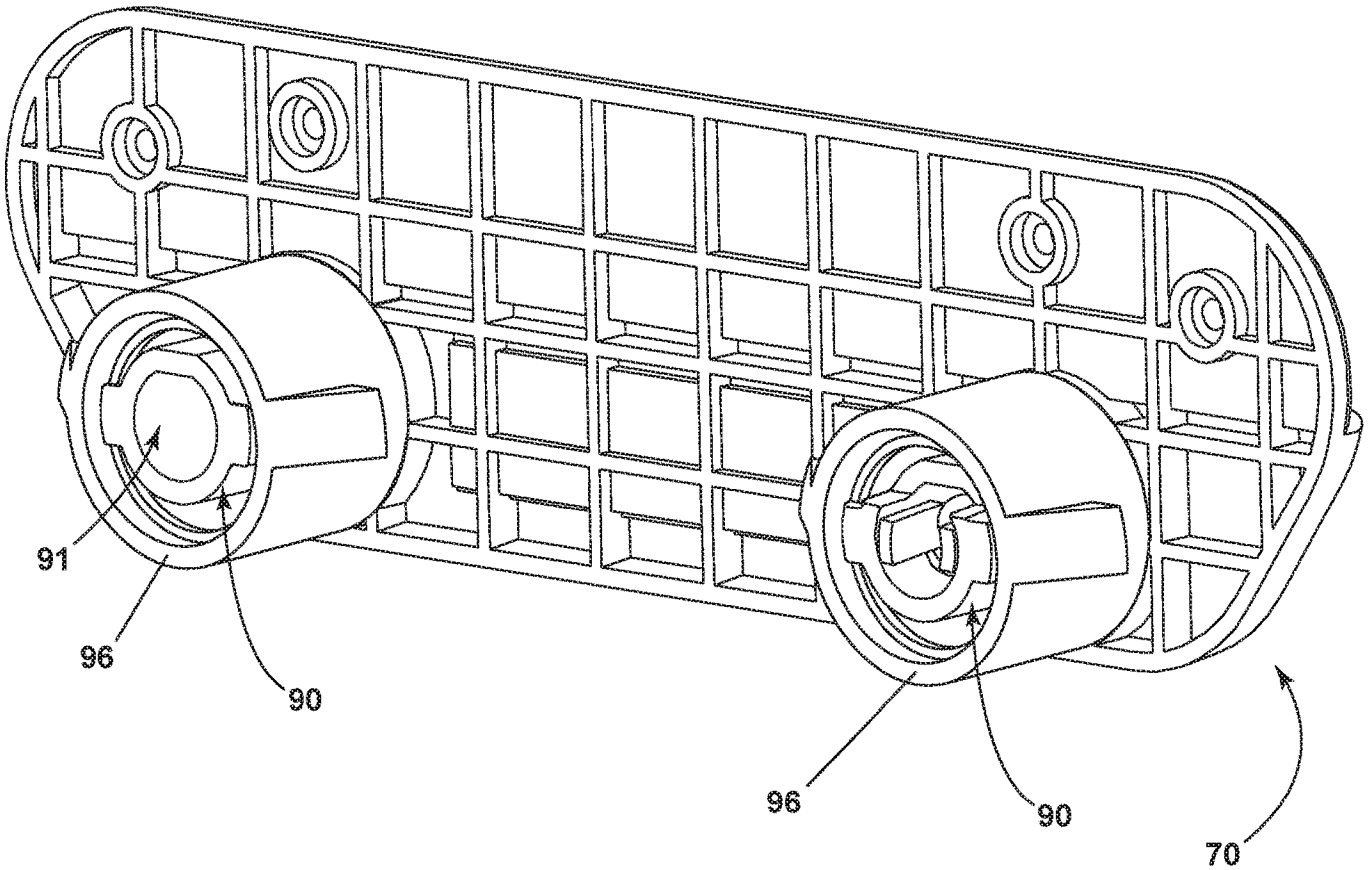
FIG. 4 is a perspective view of the rear surface of the tub mount in FIG.1 having bolt-like receptors engaged on the structural attachment points with a bayonet connection.

As illustrated in FIGS. 3 and 4, the structural attachment point 90 comprises a hollow protrusion 91 having one or more radial pins 95 designed to be received by a bolt-like receptor 96 with matching slots and a spring to form a locking connection. Although the attachment point 90 illustrated is in the form of a bayonet spring connector, other forms of connection such as screw or snap-lock connections can be used to secure the tub mount 70 to the side walls 20 (FIG. 1), in non-limiting examples.

Figure 5:
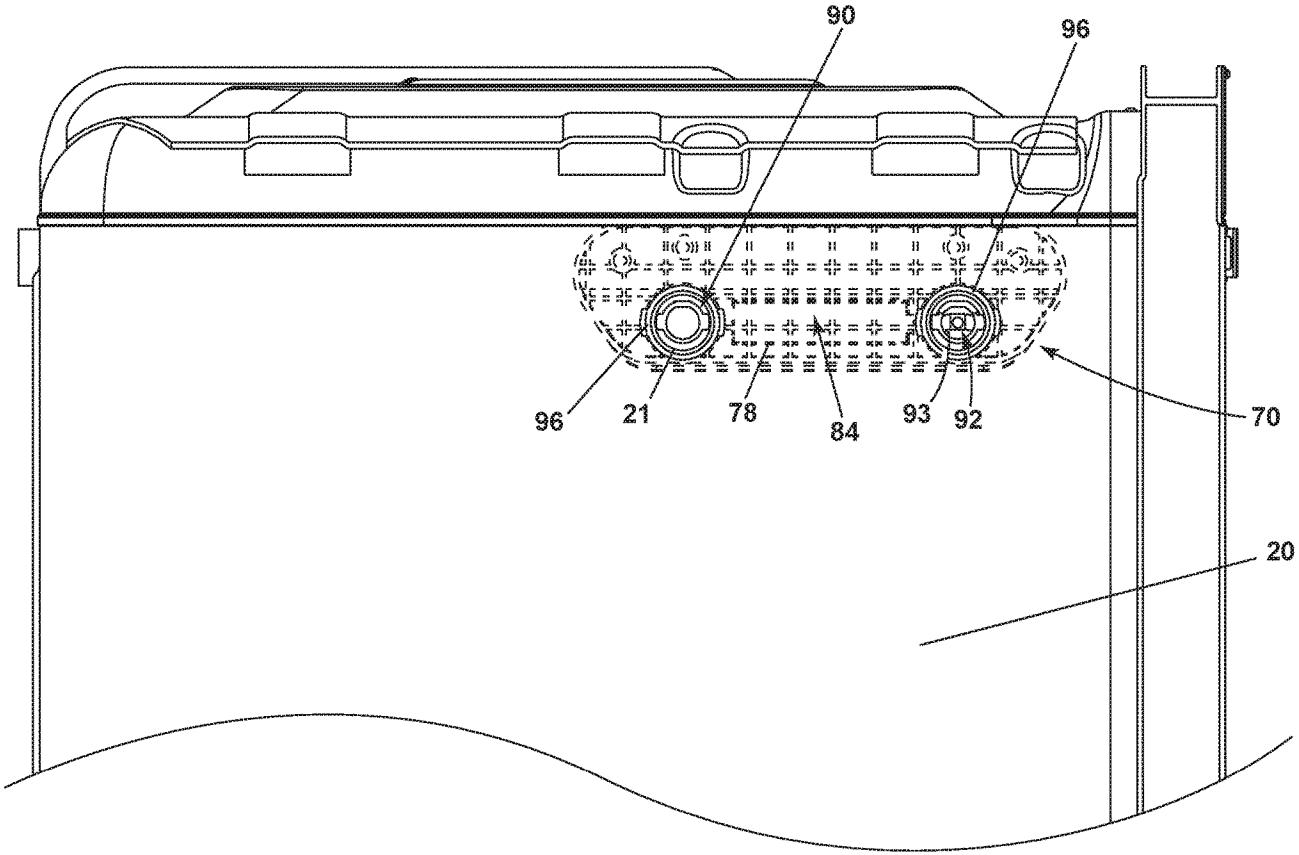
FIG. 5 is a side view of the dishwasher tub exterior adjacent a sidewall with a tub mount mounted thereto.

As shown in FIG. 5, the tub mount 70 is secured to the side walls 20 by inserting the hollow protrusion 91 of the structural attachment points 90 through an existing opening 21 on the side walls 20 from within the treating chamber 24 (FIG. 1). The tub mount 70 is fastened by coupling the bolt-like receptors 96 to the structural attachment points 90 to engage the bayonet locking mechanism. When the rail rack mount 70 is secured to the side wall 20 of the tub 14 (FIG. 1), the RAST connector 93 seated within the hollow protrusion 91 of the structural attachment point 90 is exposed to the adjacent space external to the treating chamber 24. The structure of the rail rack mount 70 provides an electrical connection for the light source 84 (FIG. 2) within the light housing 78 (FIG. 2) to a wiring harness at the exterior of the treating chamber 24 through the aperture 83 and structural attachment points 90.

The example described herein can be used for selectively illuminating the treating chamber 24 depending on the level where the tub mount 70 is installed. Depending on the configuration, the light housing 78 carrying the light source 84 from the tub mount 70 can be provided above or below the rack rail attachment point 76 and can illuminate the dishracks mounted on the same level as the tub mount 70 or the dishrack below it respectively. In both cases, having an electrical connector 92 within the structural attachment point 90 of the tub mount 70 avoids the need to create a separate opening and additional wiring of a conventional dishwasher lighting system.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher for treating dishes according to an automatic cycle of operation, comprising:

a tub having sidewalls at least partially defining a treating chamber;

a tub mount coupled to each of the sidewalls in the treating chamber via a spring bayonet connector and having at least one electrical that connection electrically connects to a wiring harness adjacent at least one of the sidewalls;

a rack rail slidably mounted to each tub mount for supporting a dishrack for movement into and out of the treating chamber; and a light mounted to each tub mount and connected to the at least one electrical connection.

2. The dishwasher of claim 1, wherein the light is a light emitting diode (LED).

3. The dishwasher of claim 2, wherein the light is an LED strip.

4. The dishwasher of claim 2, wherein the light is below the rack rail.

5. The dishwasher of claim 2, further comprising a waterproof lens to cover the light.

6. The dishwasher of claim 1, wherein at least one electrical connection is a grid-connection plug technology (RAST) connector.

7. The dishwasher of claim 6, wherein at least one electrical connection extends through an aperture in the rack rail tub mount.

8. The dishwasher of claim 1, wherein the tub mount includes multiple apertures and connectors.

9. The dishwasher of claim 8, further comprising multiple spring bayonet connections to couple the tub mount to the respective sidewall.

10. A lighting system for a dishwasher comprising:

a tub mount configured to mount a rack rail to a sidewall of a treating chamber in the dishwasher;

at least one spring bayonet connector electrical connection in the tub mount configured to electrically connect to a wiring harness adjacent the sidewall and couple the tub mount to the sidewall of the dishwasher;

a light mounted to the tub mount and connected to the at least one electrical connection.

11. The lighting system of claim 10, wherein the light is an LED.

12. The lighting system of claim 11, wherein the light is an LED strip.

13. The lighting system of claim 11, wherein the light is at a lower portion of the tub mount to be below the rack rail.

14. The lighting system of claim 11, further comprising a waterproof lens covering the light.

15. The dishwasher of claim 6, wherein at least one electrical connection extends through an aperture in the rack rail tub mount.

16. The lighting system of claim 15, wherein at least one electrical connection extends through an aperture in the rack rail tub mount.

17. The lighting system of claim 10, wherein the tub mount includes multiple apertures and connectors.

18. The lighting system of claim 17, further comprising multiple spring bayonet connections to couple the tub mount the sidewall.

* * * * *